US008305212B1

(12) United States Patent
Brumfield

(10) Patent No.: US 8,305,212 B1
(45) Date of Patent: Nov. 6, 2012

(54) DOOR SECURITY ALARM

(76) Inventor: William A. Brumfield, Benton, LA (US)

( * ) Notice: Subject to any disclaimer, the term of this patent is extended or adjusted under 35 U.S.C. 154(b) by 412 days.

(21) Appl. No.: 12/653,695

(22) Filed: Dec. 17, 2009

(51) Int. Cl.
*G08B 13/08* (2006.01)

(52) U.S. Cl. ..... 340/545.7; 340/542; 340/545.1

(58) Field of Classification Search ..... 340/545.7, 340/542, 545.1; 116/14; 200/61.62, 61.93
See application file for complete search history.

(56) References Cited

U.S. PATENT DOCUMENTS 3,569,950 A * 3/1971 Betz ..... 340/542
3,585,625 A * 6/1971 Prinsky et al. ..... 340/542
4,233,595 A * 11/1980 Landkammer ..... 340/542
5,296,841 A * 3/1994 Vormbrock ..... 340/542
6,049,276 A * 4/2000 Agozzino ..... 340/545.1

* cited by examiner

*Primary Examiner* — John A Tweel, Jr.
(74) *Attorney, Agent, or Firm* — R. Keith Harrison

(57) ABSTRACT

A door security alarm includes an alarm housing, an alarm horn provided in the alarm housing and having a horn activation button, a housing attachment bracket carried by the alarm housing and a chain slot provided in the housing attachment bracket in general proximity to the horn activation button of the alarm horn.

18 Claims, 5 Drawing Sheets

DOOR SECURITY ALARM

The disclosure generally relates to security alarms. More particularly, the disclosure relates to a door security alarm which is adapted to be mounted on a door and activated by a security chain that secures the door to emit an alarm signal in the event that an attempt is made to force the door open.

BACKGROUND

Exterior doors on many homes and other buildings, as well as interior doors to hotel rooms and the like, are commonly fitted with an interior security chain which secures the door in a partially-closed position. A chain mount bracket is typically attached to the wall adjacent to the door to be secured and a slotted door bracket is attached to the interior surface of the door. One end of an elongated security chain is attached to the chain mount bracket. The other end of the security chain is fitted with a sliding chain pin which is inserted in the elongated slot of the door bracket. Accordingly, when it is locked in place, the security chain is designed to enable partial opening of the door while preventing or hindering an intruder from forcing the door completely open. The security chain is also designed to prevent or hinder an intruder from forcing the door open when the door is closed.

One of the limitations of conventional security chains is that a strong or determined intruder can successfully push or kick the door open when the security chain is locked in place. Therefore, a door security alarm which is adapted to be mounted on a door and activated by a security chain is needed to emit an alarm signal in the event that an intruder attempts to force the door open.

SUMMARY

The disclosure is generally directed to a door security alarm. An illustrative embodiment of the door security alarm includes an alarm housing, an alarm horn provided in the alarm housing and having a horn activation button, a housing attachment bracket carried by the alarm housing and a chain slot provided in the housing attachment bracket in general proximity to the horn activation button of the alarm horn.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

As used herein, relative terms such as "upper" and "lower" are intended to be used in an illustrative and not a limiting sense. In some applications, therefore, those elements which are identified as "upper" may be located beneath those elements which are identified as "lower" in the following detailed description. Relative terms such as "top", "bottom", "upper", "lower" and "side" as used herein are to be construed as descriptive for purposes of understanding operation of the door security alarm as it is used in some exemplary applications and such relative terms may not apply in other applications. Therefore, such relative terms are not to be construed as limiting the scope of the appended claims.

Figure 1:
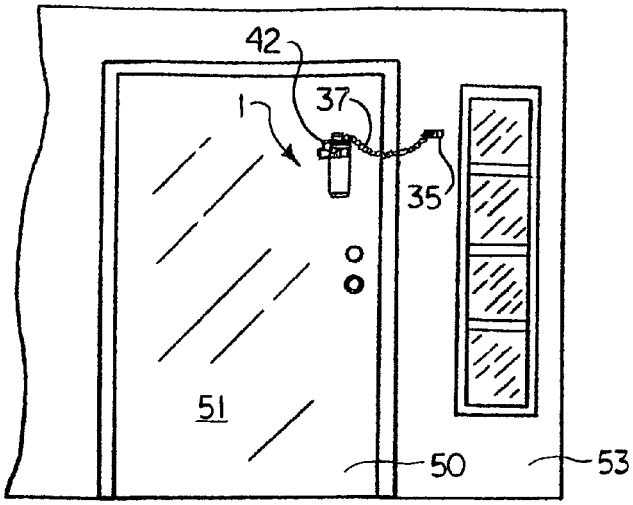
FIG. 1 is an interior view of a door, with an illustrative embodiment of the door security alarm provided on the door and a security chain attached to the door security alarm in typical application of the alarm.

Referring initially to FIGS. 1-9 of the drawings, an illustrative embodiment of the door security alarm is generally indicated by reference numeral 1. As illustrated in FIG. 1 and will be hereinafter further described, the door security alarm 1 is adapted to be mounted on an interior door surface 51 of a door 50, which may be an exterior or interior door of a residence or other building or may be a door to a hotel room or the like. The door security alarm 1 may be mounted on the door 50 in a manner which will be hereinafter described. A security chain 37 which is normally used to secure the door 50 when the door 50 is closed may be attached to the door security alarm 1 in a manner which will be hereinafter described. Accordingly, in the event that an intruder (not illustrated) on the exterior side of the door 50 attempts to force the door 50 open, the door security alarm 1 emits an alarm signal 27 (FIGS. 8 and 9) which is intended to scare the intruder and prevent the intruder from fully opening the door 50 and entering the residence or other room or building.

Figure 2:
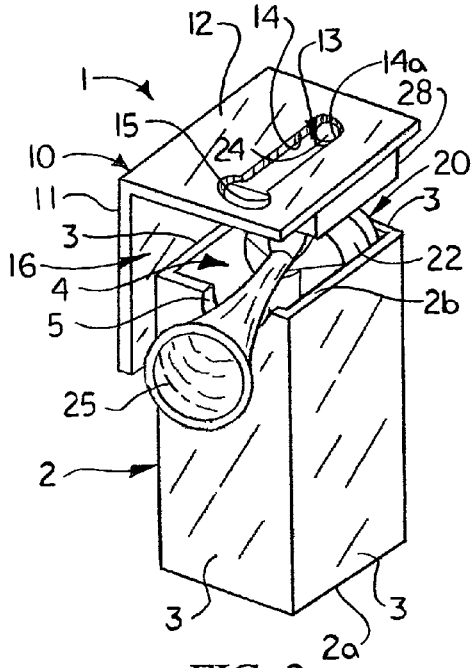
FIG. 2 is a perspective view of an illustrative embodiment of the door security alarm.
Figure 3:
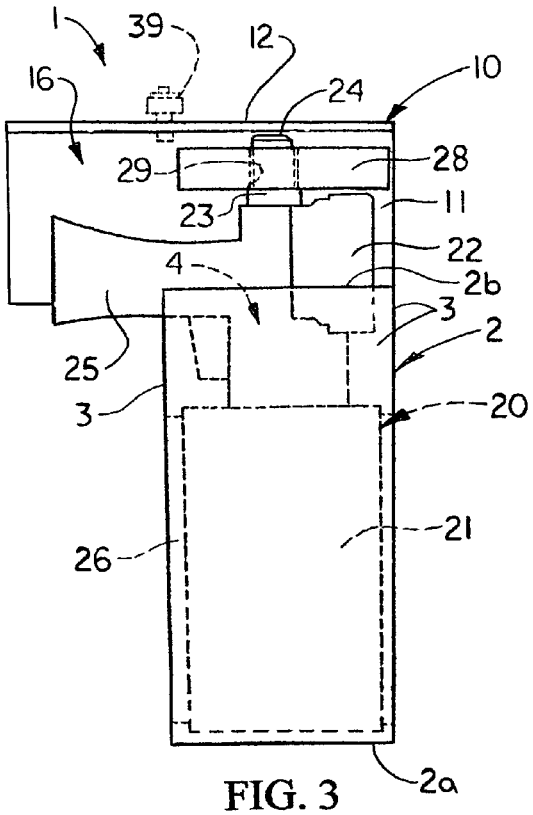
FIG. 3 is a front view of an illustrative embodiment of the door security alarm.

As illustrated in FIGS. 2 and 3, the door security alarm 1 may include an alarm housing 2 having an alarm housing interior 4. The alarm housing 2 may be metal or plastic, for example and without limitation, and may have any size, shape or design which is consistent with the functional requirements of the door security alarm 1. In some embodiments, the alarm housing 2 may have four alarm housing walls 3 which impart a generally elongated, rectangular shape to the alarm housing 2, as illustrated. In other embodiments, the alarm housing 2 may have three, five or more alarm housing walls 3 which impart an alternative shape to the alarm housing 2. Further in the alternative, the alarm housing 2 may have a generally cylindrical configuration. The alarm housing 2 may have a first end 2*a* and a second end 2*b* which is opposite the first end 2*a*. As illustrated in FIG. 2, in some embodiments a cone notch 5 may be provided in the second end 2*b* of the alarm housing 2 for purposes which will be hereinafter described.

A housing attachment bracket 10 may be provided on the alarm housing 2. In some embodiments, the housing attachment bracket 10 may have a generally L-shaped configuration and may include an attachment portion 11 and a slotted portion 12 which extends from and is generally perpendicular to the attachment portion 11. A horn space 16 may be defined between the second end 2*b* of the alarm housing 2 and the slotted portion 12 of the housing attachment bracket 10.

Figure 7:
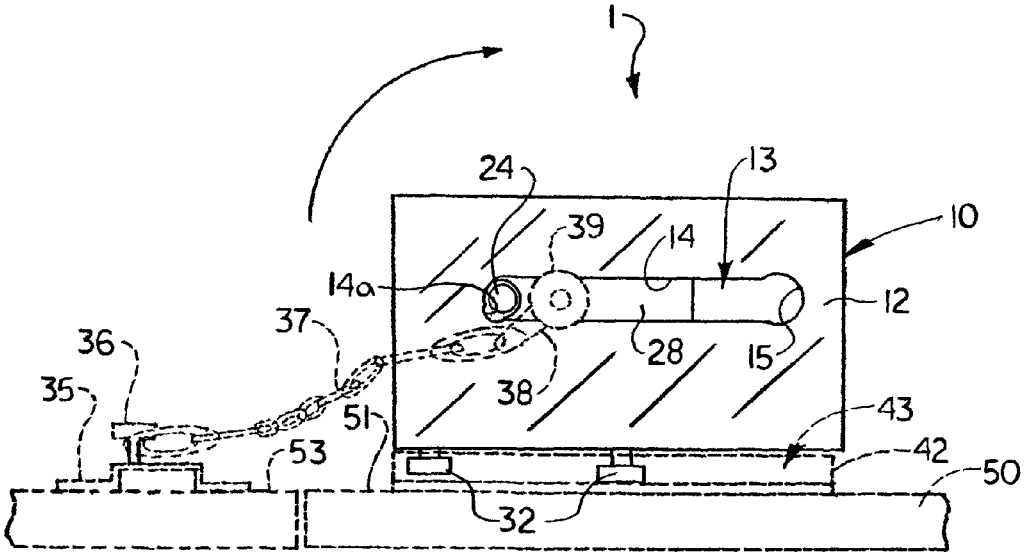
FIG. 7 is a top view of an illustrative embodiment of the door security alarm, mounted on a door bracket (illustrated in phantom) provided on a rightward-opening door (illustrated in phantom) and attached to a security chain (illustrated in phantom) attached to a wall (illustrated in phantom) adjacent to the door, with the door illustrated in a closed position.
Figure 8:
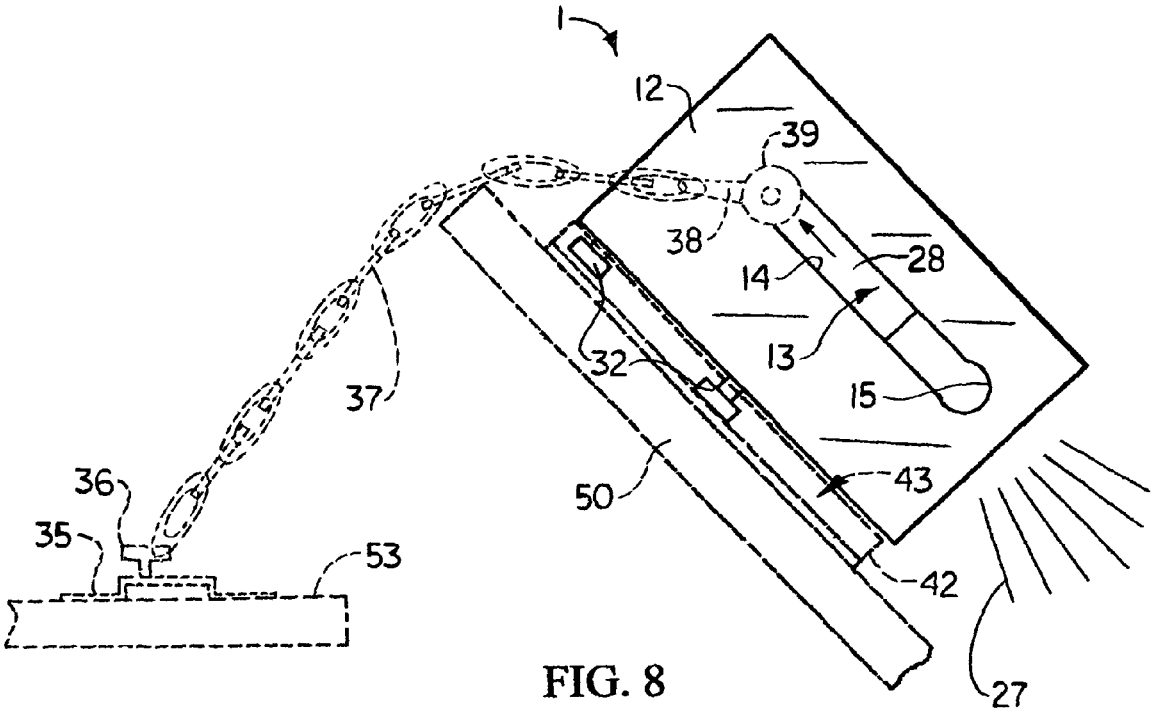
FIG. 8 is a top view of an illustrative embodiment of the door security alarm in exemplary application thereof as illustrated in FIG. 7, with the door illustrated in a forced-open position and the door security alarm in an activated state.

As illustrated in FIGS. 2, 7 and 8, a generally elongated chain slot 13 may be provided in the slotted portion 12 of the housing attachment bracket 10. The chain slot 13 may include an elongated main slot portion 14 having a slot end 14*a*. An enlarged slot portion 15 may terminate the end of the main slot portion 14 which is opposite the slot end 14*a*. The purpose of the chain slot 13 will be hereinafter described.

Figure 4:
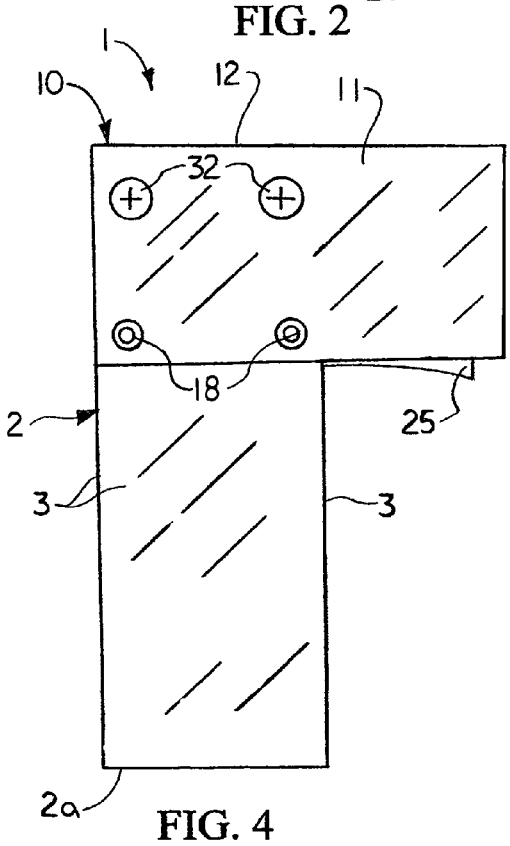
FIG. 4 is a rear view of an illustrative embodiment of the door security alarm.
Figure 5:
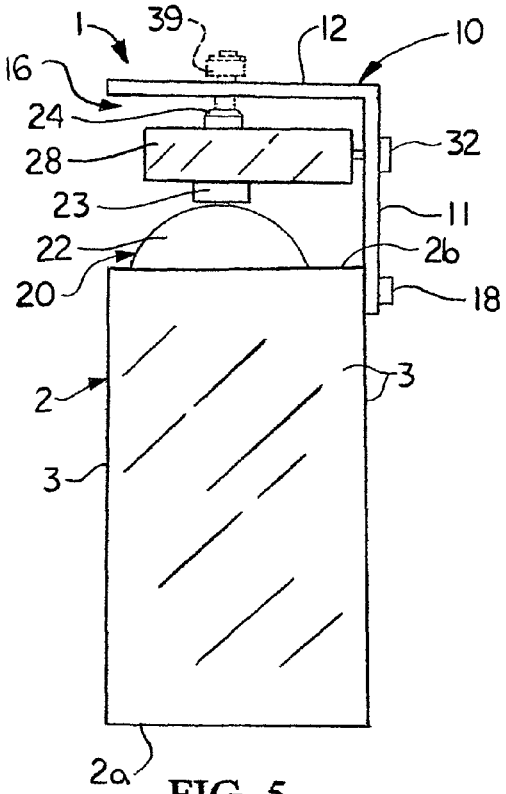
FIG. 5 is left side view of an illustrative embodiment of the door security alarm.
Figure 6:
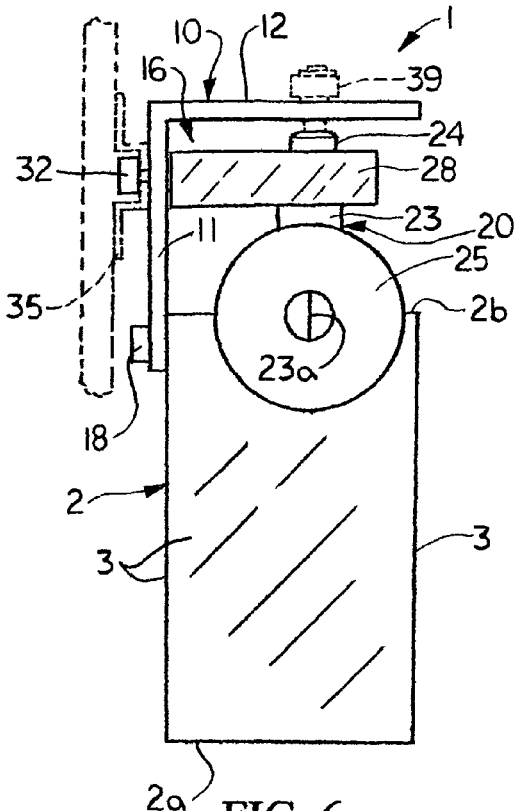
FIG. 6 is a right side view of an illustrative embodiment of the door security alarm.

The attachment portion 11 of the housing attachment bracket 10 may be attached to the alarm housing 2 according to any suitable technique which is known by those skilled in the art. As illustrated in FIGS. 4-6, in some embodiments, bracket attachment bolts 18 may be extended through respective bolt openings (not illustrated) provided in the attachment portion 11 and threaded into respective registering bolt openings (not illustrated) provided in the alarm housing 2. In other embodiments, alternative attachment techniques known by those skilled in the art may be used to attach the attachment portion 11 of the housing attachment bracket 10 to the alarm housing 2.

An alarm horn 20 may be provided in the alarm housing interior 4 of the alarm housing 2. In some embodiments, the alarm horn 20 may be a conventional personal safety air horn which is adapted to emit an alarm signal 27 (FIGS. 8 and 9) upon depression of a horn activation button 23 (FIG. 3) provided on the alarm horn 20, as is known by those skilled in the art. An example of an alarm horn which is suitable for the purpose is the personal safety horn which is available from Falcon Safety Products, Inc., of Branchburg, N.J. As illustrated in phantom in FIG. 3, in some embodiments, the alarm horn 20 may include a fluid reservoir 21 which contains a supply of pressurized gas (not illustrated) such as tetrafluoroethane, for example and without limitation. A horn housing 22 may be disposed in fluid communication with the fluid reservoir 21. A flared amplifier cone 25 may extend from the horn housing 22. The horn activation button 23 may be provided on the horn housing 22. A horn pin 23*a* (FIG. 6) which is engaged by the horn activation button 23 may be adapted to open an outlet (not illustrated) for the gas in the fluid reservoir 21 responsive to depression of the horn activation button 23. Accordingly, upon depression of the horn activation button 23, gas (not illustrated) is released under pressure from the fluid reservoir 21 into the horn housing 22 and produces an alarm signal 27 which is emitted from the horn housing 22 through the amplifier cone 25.

As further illustrated in FIG. 3, the fluid reservoir 21 of the alarm horn 20 may be contained in the alarm housing interior 4 of the alarm housing 2. In some embodiments, a sleeve 26 may be provided in the alarm housing interior 4 to provide a tight fit between the fluid reservoir 21 and the alarm housing 2. The sleeve 26 may be a resilient material such as rubber or plastic, for example and without limitation. Alternative techniques known by those skilled in the art may be used to secure the fluid reservoir 21 of the alarm horn 20 in the alarm housing interior 4 of the alarm housing 2. The horn housing 22 and the amplifier cone 25 of the alarm horn 20 may be disposed within the horn space 16 between the housing attachment bracket 10 and the second end 2*b* of the alarm housing 2. As illustrated in FIG. 2, the amplifier cone 25 may be seated in the cone notch 5 provided in the second housing end 2*b*.

As illustrated in FIGS. 2 and 3, a pin bearing block 28 through which extends a pin opening 29 (FIG. 3) may be provided in the horn space 16. A floating activating pin 24 may be disposed within the pin opening 29 of the pin bearing block 28 and engages the horn activation button 23 of the alarm horn 20. As illustrated in FIG. 7, the activating pin 24 may be disposed generally beneath the slot end 14*a* of the chain slot 13 for purposes which will be hereinafter described. In some embodiments, the upper end of the activating pin 24 may be beveled, as illustrated.

The pin bearing block 28 may be mounted in the horn space 16 according to any suitable technique which is known by those skilled in the art. As illustrated in FIGS. 4-6, in some embodiments, multiple alarm mount bolts 32 may be extended through respective bolt openings (not illustrated) provided in the housing attachment bracket 10 and threaded into respective registering bolt openings (not illustrated) provided in the pin bearing block 28. The alarm mount bolts 32 may also facilitate attachment of the door security alarm 1 to the door 50 (FIG. 1) in application of the door security alarm 1, as will be hereinafter described. In other embodiments, alternative techniques known by those skilled in the art may be used to mount the pin bearing block 28 in the horn space 16.

Referring next to FIGS. 1 and 7-9 of the drawings, in an exemplary application, the door security alarm 1 is mounted on a door 50 to a residence or building or a door 50 to a room within a residence or building, for example and without limitation. When closed, the door 50 may be secured by a security chain 37 which may have a conventional design and enables partial opening of the door 50 while hindering the door 50 from being forced completely open by an intruder (not illustrated) outside the door 50. A chain mount bracket 35 may be attached to a wall 53 adjacent to the door 50. A first end of the security chain 37 may be attached to a chain mount bolt 36 (FIG. 7) which is provided on the chain mount bracket 35. A security chain clevis 38 may be provided on a second end of the security chain 37. A chain pin 39 may be provided on the security chain clevis 38. An elongated door bracket 42 (illustrated in phantom in FIGS. 7 and 8) having an elongated bracket slot 43 may be attached to the interior door surface 51 of the door 50. Accordingly, in normal use of the security chain 37, the door 50 is closed and secured by inserting and sliding the chain pin 39 in the bracket slot 43 of the door bracket 42.

Prior to attachment of the door security alarm 1 to the door 50, the chain pin 39 on the security chain 37 is removed from the bracket slot 43 of the door bracket 42. As illustrated in FIG. 7, with the door 50 in the closed position, the door security alarm 1 may be mounted on the interior door surface 51 of the door 50 by sliding the alarm mount bolts 32 on the door security alarm 1 into the elongated bracket slot 43 provided in the door bracket 42 on the door 50. The chain pin 39 provided on the security chain 37 is then initially inserted into the enlarged portion 15 and then slid into the adjacent main slot portion 14 of the chain slot 13 provided in the slotted portion 12 of the housing attachment bracket 10 on the door security alarm 1 until the chain pin 39 is generally adjacent to the activating pin 24 beneath the slot end 14*a* of the chain slot 13. When the chain pin 39 is inserted in the chain slot 13, the security chain 37 may be in a slackened state. Therefore, the door 50 may be partially opened without causing the chain pin 39 to traverse the chain slot 13 to the slot end 14*a* of the main slot portion 14.

Figure 9:
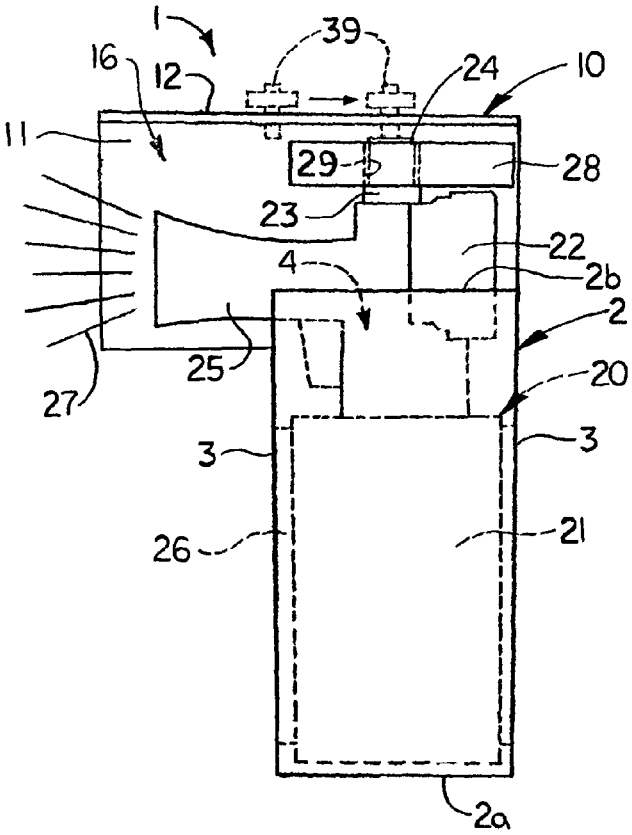
FIG. 9 is front view of an illustrative embodiment of the door security alarm, illustrated in the activated state.

In the event that an intruder (not illustrated) outside the door 50 attempts to force the door 50 open when it is closed or attempts to force the door completely open when it is partially open and secured by the security chain 37, such as by pushing or kicking the door 50, as illustrated in FIG. 8, the security chain 37 becomes taut as the door 50 pivots open and the door security alarm 1 mounted thereon travels away from the wall 53 to which the security chain 37 is attached. Therefore, the security chain 37 constrains movement of the chain pin 39 which slides along the chain slot 13, as indicated by the arrow in FIG. 8, until it is stopped by the slot end 14*a* of the chain slot 13. As illustrated in FIG. 9, as it slides against the slot end 14*a* of the chain slot 13, the chain pin 39 depresses the activating pin 24 which floats within the pin opening 29 provided in the pin bearing block 28. The activating pin 24, in turn, depresses the horn activation button 23 of the alarm horn 20. The depressed horn activation button 23 causes the horn pin 23*a* (FIG. 6) to release pressurized gas (not illustrated) from the fluid reservoir 21 into the horn housing 22 of the alarm horn 20. Consequently, an alarm signal 27 (FIGS. 8 and 9) is emitted from the amplifier cone 25 of the alarm horn 20, scaring the intruder and preventing the intruder from completely forcing the door 50 open and entering the residence or other room or building. Upon subsequent closing of the door 50, the chain pin 39 may move or be moved away from the slot end 14*a* of the chain slot 13, disengaging the activating pin 24 and terminating further emission of the alarm signal 27 from the amplifier cone 25 of the alarm horn 20. When not in use, the door security alarm 1 can be selectively detached from the door 50 by first removing the chain pin 39 from the enlarged portion 15 of the chain slot 13 and then sliding the alarm mount bolts 32 from the bracket slot 43 of the door bracket 42.

Figure 10:
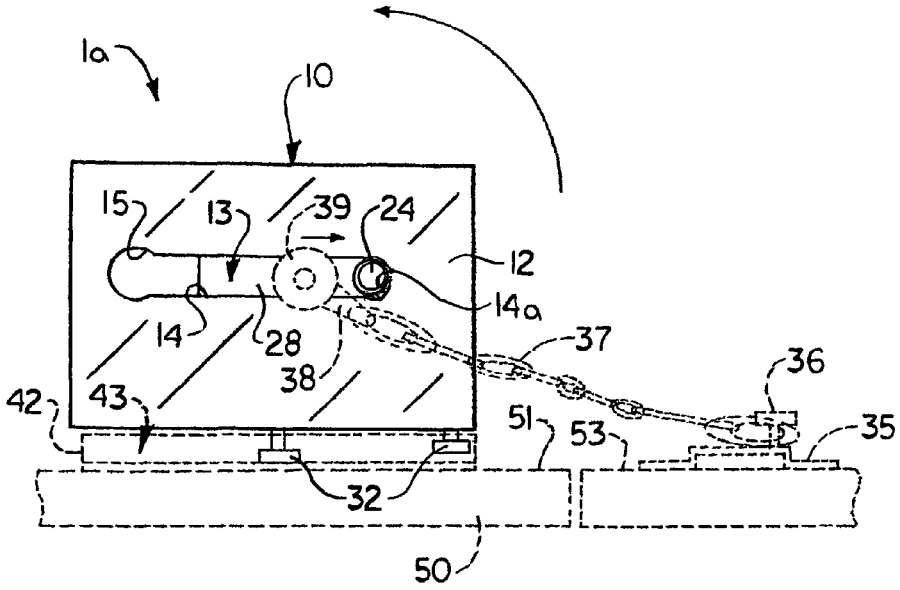
FIG. 10 is a top view of an illustrative embodiment of the door security alarm, mounted on a door bracket (illustrated in phantom) provided on a leftward-opening door (illustrated in phantom) and attached to a security chain (illustrated in phantom) attached to a wall (illustrated in phantom) adjacent to the door, with the door illustrated in a closed position.

The door security alarm 1 which is illustrated in FIGS. 7 and 8 is adapted for use on a door 50 which opens to the right relative to the exterior of the door 50, as illustrated in FIG. 8. As illustrated in FIG. 10, an alternative illustrative embodiment of the door security alarm 1*a* is adapted for use on a door 50 which opens to the left relative to the exterior of the door 50. Accordingly, in the door security alarm 1*a*, the side of the alarm housing 2 to which the housing attachment bracket 10 is attached is opposite relative to the side of the alarm housing 2 to which the housing attachment bracket 10 is attached in the door security alarm 1.

Figure 11:
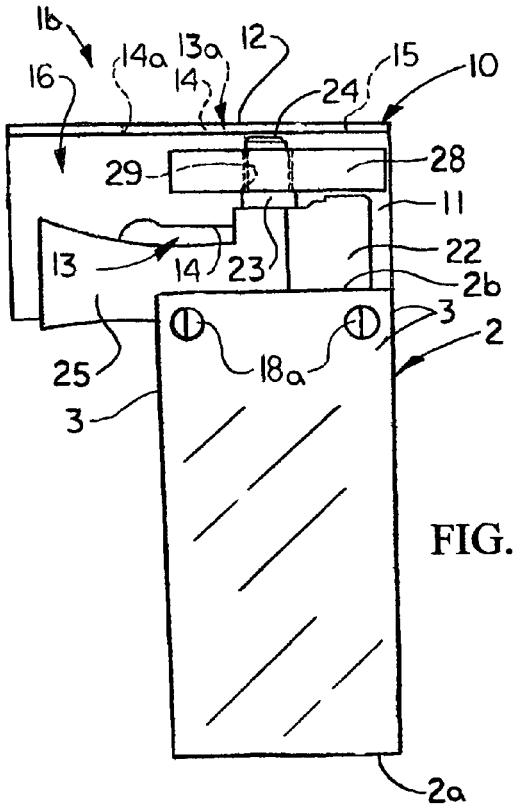
FIG. 11 is a front view of an alternative illustrative embodiment of the door security alarm.
Figure 12:
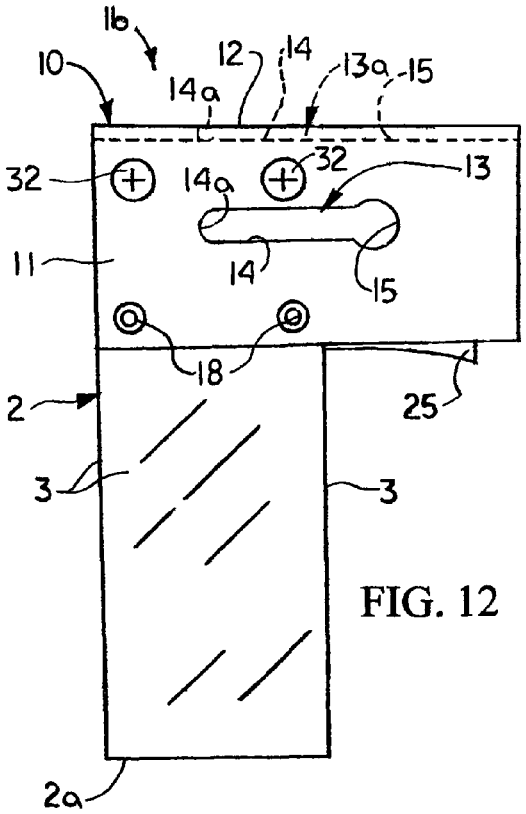
FIG. 12 is a rear view of the door security alarm illustrated in FIG. 11.
Figure 13:
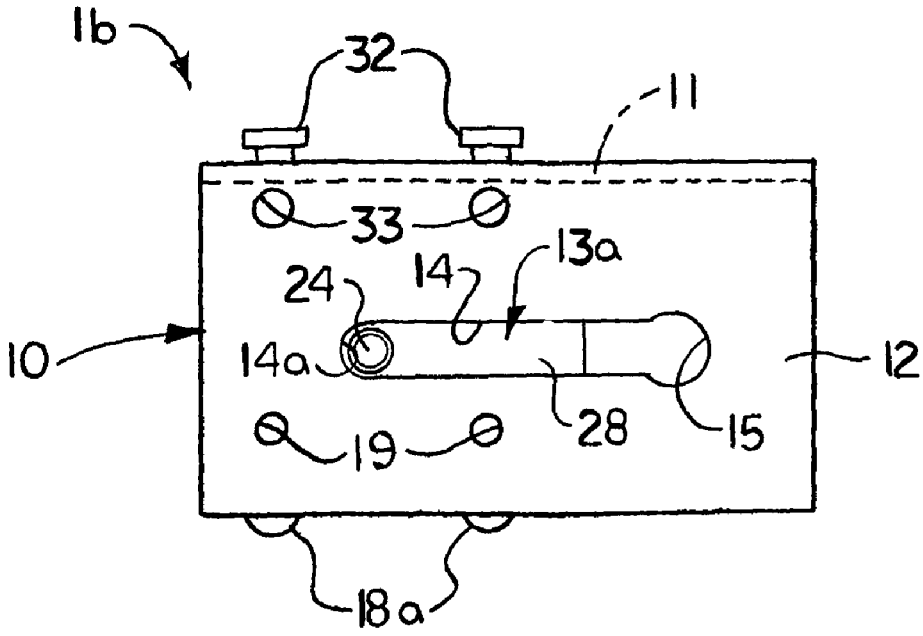
FIG. 13 is a top view of the door security alarm illustrated in FIG. 11, with the housing attachment bracket oriented for attachment of the alarm to a rightward-opening door (not illustrated)

Referring next to FIGS. 11-14 of the drawings, another alternative illustrative embodiment of the door security alarm is generally indicated by reference numeral 1*b*. In the door security alarm 1*b*, a first chain slot 13 may be provided in the attachment portion 11 and a second chain slot 13*a* may be provided in the slotted portion 12 of the housing attachment bracket 10. As illustrated in FIG. 13, a pair of bracket attachment bolt openings 19 and a pair of alarm mount bolt openings 33 may also be provided in each of the attachment portion 11 and the slotted portion 12. Accordingly, in the event that the door security alarm 1*b* is to be attached to a rightward-opening door 50, as was heretofore described with respect to FIGS. 7 and 8, the housing attachment bracket 10 may be attached to the alarm housing 2 by extending a first pair of bracket attachment bolts 18 (FIG. 12) through the respective bracket attachment bolt openings 19 (FIG. 14) provided in the attachment portion 11 of the housing attachment bracket 10 and threaded into respective registering bolt openings (not illustrated) provided in the alarm housing 2. The alarm mount bolts 32 may be extended through the respective alarm mount bolt openings 33 (FIG. 14) provided in the attachment portion 11 of the housing attachment bracket 10, as illustrated in FIG. 13. In some embodiments, the alarm mount bolt openings 33 may additionally be threaded into respective bolt openings (not illustrated) provided in the pin bearing block 28 (FIG. 11) to support the pin bearing block 28 in the horn space 16. As illustrated in FIG. 11, a pair of bracket attachment bolts 18*a* may normally be threaded into respective bolt openings (not illustrated) provided in the side of the alarm housing 2 which is opposite the side of the alarm housing 2 to which the housing attachment bracket 10 is attached. The housing attachment bracket 10 may be attached to the door bracket 42 (FIG. 7) provided on the door 50 by sliding the alarm mount bolts 32 into the bracket slot 43 of the door bracket 42. The chain pin 39 (FIG. 8) provided on the security chain 37 may be inserted in the second chain slot 13*a* in the slotted portion 12 of the housing bracket 10.

Figure 14:
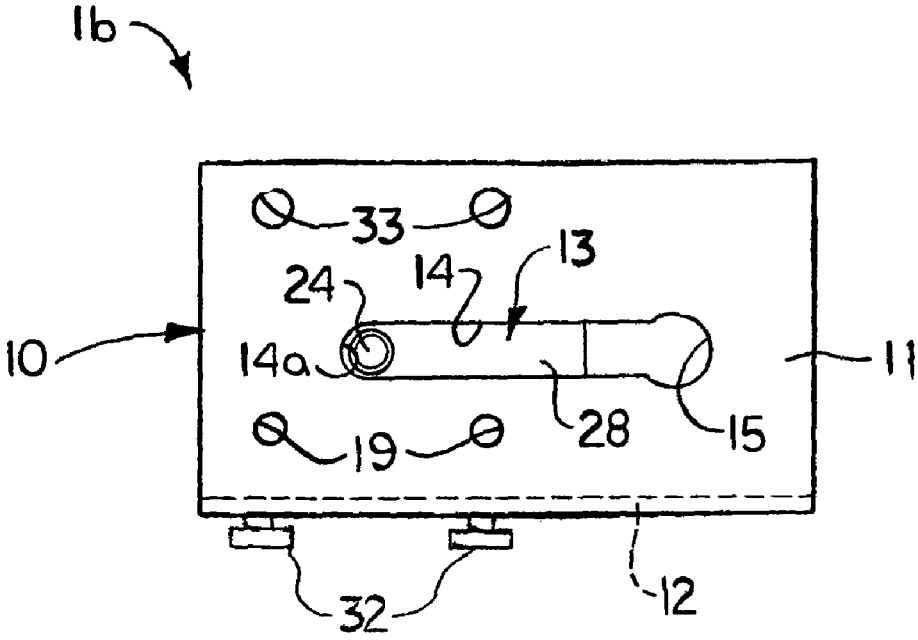
FIG. 14 is a top view of the door security alarm illustrated in FIG. 11, with the housing attachment bracket re-oriented for attachment of the alarm to a leftward-opening door (not illustrated).

In the event that the door security alarm 1*b* is to be attached to a leftward-opening door 50, as was heretofore described with respect to FIG. 10, the attachment portion 11 of the housing attachment bracket 10 may be detached from the alarm housing 2, the housing attachment bracket 10 re-oriented and the slotted portion 12 attached to the alarm housing 2 by initially removing the second pair of bracket attachment bolts 18*a* (FIG. 13) from the respective bolt openings and then extending the second pair of bracket attachment bolts 18*a* through the respective bracket attachment bolt openings 19 provided in the slotted portion 12 of the housing attachment bracket 10 and threading the second pair of attachment bracket bolts 18*a* into respective registering bolt openings (not illustrated) provided in the side of the alarm housing 2 which is opposite the side of the alarm housing 2 to which the housing attachment bracket 10 was attached in FIGS. 11-13. The alarm mount bolts 32 may be extended through the respective alarm mount bolt openings 33 provided in the slotted portion 12 of the housing attachment bracket 10, as illustrated in FIG. 14. In some embodiments, the alarm mount bolts 32 may additionally be threaded into respective bolt openings (not illustrated) provided in the pin bearing block 28 (FIG. 11) to support the pin bearing block 28 in the horn space 16. The housing attachment bracket 10 may then be attached to the door bracket 42 (FIG. 10) provided on the door 50 by sliding the alarm mount bolts 32 into the bracket slot 43 of the door bracket 42. The chain pin 39 (FIG. 8) provided on the security chain 37 may be inserted in the first chain slot 13 in the attachment portion 11 of the housing bracket 10.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A door security alarm, comprising:

an alarm housing;

an alarm horn provided in said alarm housing and having a horn activation button;

a housing attachment bracket carried by said alarm housing;

a chain slot provided in said housing attachment bracket in general proximity to said horn activation button of said alarm horn;

an activating pin between said chain slot and said horn activation button; and a pin bearing block having a pin opening, said activating pin is disposed in said pin opening.

2. The door security alarm of claim 1 wherein said pin bearing block is carried by said housing attachment bracket.

3. The door security alarm of claim 1 wherein said housing attachment bracket comprises an attachment portion carried by said alarm housing and a slotted portion carried by said attachment portion, and wherein said chain slot is provided in said slotted portion.

4. The door security alarm of claim 1 wherein said chain slot comprises a generally elongated main slot portion having a slot end disposed in general proximity to said horn activation button of said alarm horn and an enlarged slot portion opposite said slot end.

5. The door security alarm of claim 1 further comprising a plurality of bracket attachment bolts securing said housing attachment bracket to said alarm housing.

6. The door security alarm of claim 1 wherein said alarm housing comprises a plurality of alarm housing walls.

7. A door security alarm, comprising:

an alarm housing having a first end, a second end opposite said first end and an alarm housing interior between said first end and said second end;

an alarm horn having a horn activation button provided in said alarm housing interior of said alarm housing;

a housing attachment bracket having an attachment portion carried by said alarm housing and a slotted portion carried by said attachment portion in spaced-apart relationship with respect to said second end of said alarm housing;

a horn space defined between said slotted portion of said housing attachment bracket and said second end of said alarm housing;

a pin bearing block having a pin opening disposed in said horn space;

an activating pin disposed in said pin opening of said pin bearing block and engaging said horn activation button of said alarm horn; and a chain slot provided in said slotted portion of said housing attachment bracket and disposed in general proximity to said activating pin.

8. The door security alarm of claim 7 wherein said pin bearing block is carried by said housing attachment bracket.

9. The door security alarm of claim 7 wherein said chain slot comprises a generally elongated main slot portion having a slot end disposed in general proximity to said activating pin and an enlarged slot portion opposite said slot end.

10. The door security alarm of claim 7 further comprising a plurality of bracket attachment bolts securing said attachment portion of said housing attachment bracket to said alarm housing.

11. The door security alarm of claim 7 wherein said alarm housing comprises a plurality of alarm housing walls.

12. The door security alarm of claim 7 further comprising a plurality of alarm mount bolts carried by said alarm housing and wherein said pin bearing block is carried by said plurality of alarm mount bolts.

13. A door security alarm, comprising:

a generally elongated alarm housing having a first end, a second end opposite said first end and an alarm housing interior between said first end and said second end;

a housing attachment bracket having an attachment portion releasably carried by said alarm housing and a slotted portion carried by said attachment portion in spaced-apart relationship with respect to said second end of said alarm housing;

a horn space defined between said slotted portion of said housing attachment bracket and said second end of said alarm housing;

an alarm horn having a horn activation button provided in said al arm housing interior;

a pin bearing block having a pin opening disposed in said horn space;

an activating pin disposed in said pin opening of said pin bearing block and engaging said horn activation button of said alarm horn;

a first chain slot provided in said slotted portion of said housing attachment bracket in general proximity to said activating pin; and a second chain slot provided in said attachment portion of said housing attachment bracket.

14. The door security alarm of claim 13 wherein said pin bearing block is carried by said attachment portion of said housing attachment bracket.

15. The door security alarm of claim 13 wherein said first chain slot comprises a generally elongated first main slot portion having a first slot end disposed in general proximity to said activating pin and a first enlarged slot portion opposite said first slot end and said second chain slot comprises a generally elongated second main slot portion having a second slot end and a second enlarged slot portion opposite said second slot end.

16. The door security alarm of claim 13 further comprising a plurality of bracket attachment bolts releasably securing said attachment portion of said homing attachment bracket to said alarm housing.

17. The door security alarm of claim 13 wherein said alarm housing comprises a plurality of alarm housing walls.

18. The door security alarm of claim 13 further comprising a plurality of alarm mount bolts carried by said alarm housing and wherein said pin bearing block is carried by said plurality of alarm mount bolts.

* * * * *